US006572121B2

(12) United States Patent
Shih

(10) Patent No.: US 6,572,121 B2
(45) Date of Patent: Jun. 3, 2003

(54) SHOE AND WHEEL COMBINATION HAVING DETACHABLE STRUCTURE

(76) Inventor: Fang Chuan Shih, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/968,137

(22) Filed: Sep. 28, 2001

(65) Prior Publication Data

US 2003/0062696 A1 Apr. 3, 2003

(51) Int. Cl.[7] ..... A63C 1/04; A63C 1/02; A43B 5/16

(52) U.S. Cl. ..... 280/11.33; 280/11.31; 280/11.3; 36/115

(58) Field of Search ..... 280/7.13, 11.221, 280/11.231, 11.26, 11.27, 11.35, 11.31, 7.1, 7.12, 11.3, 11.33; 36/115

(56) References Cited

U.S. PATENT DOCUMENTS

| | | | | | |
|---|---|---|---|---|---|
| 3,918,729 | A | * | 11/1975 | Peters | 280/11.3 |
| 4,666,168 | A | * | 5/1987 | Hamill et al. | 280/11.2 |
| 5,662,338 | A | * | 9/1997 | Steinhauser, Jr. | 280/7.14 |
| 5,839,734 | A | * | 11/1998 | Steinhauser, Jr. | 280/7.13 |
| 6,015,156 | A | * | 1/2000 | Pratt | 280/11.22 |
| 6,053,512 | A | | 4/2000 | Chang | 280/11.22 |
| 6,120,038 | A | * | 9/2000 | Dong et al. | 280/7.13 |
| 6,120,040 | A | * | 9/2000 | Svensson et al. | 280/11.224 |
| 6,145,854 | A | * | 11/2000 | Cheng | 280/11.22 |
| 6,164,669 | A | * | 12/2000 | Svensson | 280/11.3 |
| 6,344,621 | B1 | * | 1/2001 | Chang | 280/11.3 |
| 6,270,089 | B1 | * | 8/2001 | Marechal | 280/11.3 |
| 6,322,088 | B1 | * | 11/2001 | Klamer et al. | 280/11.27 |
| 6,382,638 | B1 | * | 5/2002 | Lee | 280/7.13 |
| 6,386,556 | B1 | * | 5/2002 | Yeh | 280/11.223 |
| 2002/0158428 | A1 | * | 10/2002 | Lin | 280/11.221 |

FOREIGN PATENT DOCUMENTS

| | | | | |
|---|---|---|---|---|
| WO | WO 93/07938 | * | 4/1993 | 280/7.13 |

* cited by examiner

*Primary Examiner*—Frank Vanaman
*Assistant Examiner*—G B Klebe
(74) *Attorney, Agent, or Firm*—Charles E. Baxley

(57) ABSTRACT

A shoe and a wheel device include one end detachably secured together with a projection-and-lock notch engagement. A toe member and a separate heel member are engaged on the front and the rear portions of the shoe. A latch is attached to the wheel device for latching and securing the heel member and the rear portion of the shoe to the wheel device. A quick release lock device is attached to the middle portion of the wheel device and engageable with the heel member for locking the heel member and the middle portion of the shoe to the wheel device.

8 Claims, 5 Drawing Sheets

SHOE AND WHEEL COMBINATION HAVING DETACHABLE STRUCTURE

BACKGROUND OF THE INVENTION

1. Field of the Invention

The present invention relates to a shoe and wheel combination, and more particularly to a shoe and wheel combination including an easily and quickly detachable structure or configuration.

2. Description of the Prior Art

Various kinds of typical shoe and wheel combinations have been developed and used today, and comprise a wheel device for detachably securing to the bottom of the shoe. Normally, the shoe includes two or more fasteners extended downward therefrom for securing the wheel device to the bottom thereof together with the other or the additional lock nuts or the like. The lock nuts may not be easily unthreaded and disengaged from the fasteners.

U.S. Pat. No. 6,035,512 to Chang discloses the other type of shoe and wheel combination including a wheel device having one end rotatably secured to one end of the shoe with a pivot shaft, and having the other end detachably secured to the shoe with a lock device or the like. However, the pivot shaft may not be easily disengaged from the shoe, such that the wheel device may not be easily and quickly disengaged from the shoe after the lock device has been disengaged from the shoe, and such that the wheel device may not be easily disengaged from the shoe.

The present invention has arisen to mitigate and/or obviate the afore-described disadvantages of the conventional shoe and wheel combinations.

SUMMARY OF THE INVENTION

The primary objective of the present invention is to provide a shoe and wheel combination including an easily and quickly detachable structure or configuration.

In accordance with one aspect of the invention, there is provided a shoe and wheel combination comprising a shoe including a first portion, a middle portion and a rear portion, a toe member engaged onto the front portion of the shoe, a heel member engaged onto the rear portion of the shoe, a wheel device including a front portion, a middle portion, and a rear portion, means for detachably securing the front portion of the wheel device and the toe member together to detachably secure the front portion of the shoe between the toe member and the front portion of the wheel device, and means for detachably latching the rear portion of the wheel device and the heel member together to detachably secure the rear portion of the shoe between the heel member and the rear portion of the wheel device.

The detachably securing means includes at least one block extended downward from the toe member and engaged into the front portion of the shoe, and at least one projection provided on the front portion of the wheel device for engaging with the block.

The block includes a lock notch formed therein for receiving the projection of the wheel device. The wheel device includes a plate provided on the front portion thereof, and a catch extended upward from the plate, the projection is extended forward from the catch.

The detachably latching means includes at least one protrusion extended downward from the heel member and engaged into the rear portion of the shoe, and a latch provided on the rear portion of the wheel device for engaging with the protrusion and for latching the rear portion of the wheel device and the heel member together.

The wheel device includes at least one conduit provided on the rear portion thereof and having an opening formed therein, the protrusion includes an orifice formed therein and aligned with the opening of the conduit for receiving the latch.

The latch includes a middle portion rotatably secured to the rear portion of the wheel device with a pivot shaft, and includes a first end having a hook for engaging into the opening of the conduit and the orifice of the protrusion. A spring biasing device may further be provided for biasing the latch to engage with the protrusion.

A device may further be provided for locking the heel member to the middle portion of the wheel device and includes a quick release lock device attached to the middle portion of the wheel device and engageable with the heel member for locking the heel member to the middle portion of the wheel device.

The quick release lock device includes a lever rotatably secured to the middle portion of the wheel device, and an arm having a first end rotatably secured to the lever and a second end for engaging with the heel member and for locking the heel member to the middle portion of the wheel device.

The heel member includes a casing extended downward therefrom and engaged into the shoe, the arm is engaged with the casing for locking the casing to the wheel device. The casing includes an aperture formed therein for receiving the arm. The shoe includes a housing extended downward therefrom and having an aperture formed therein for receiving the arm.

A receptacle is further provided on the middle portion of the wheel device for receiving the casing and includes an orifice formed therein for receiving the arm and for allowing the arm to engage with the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
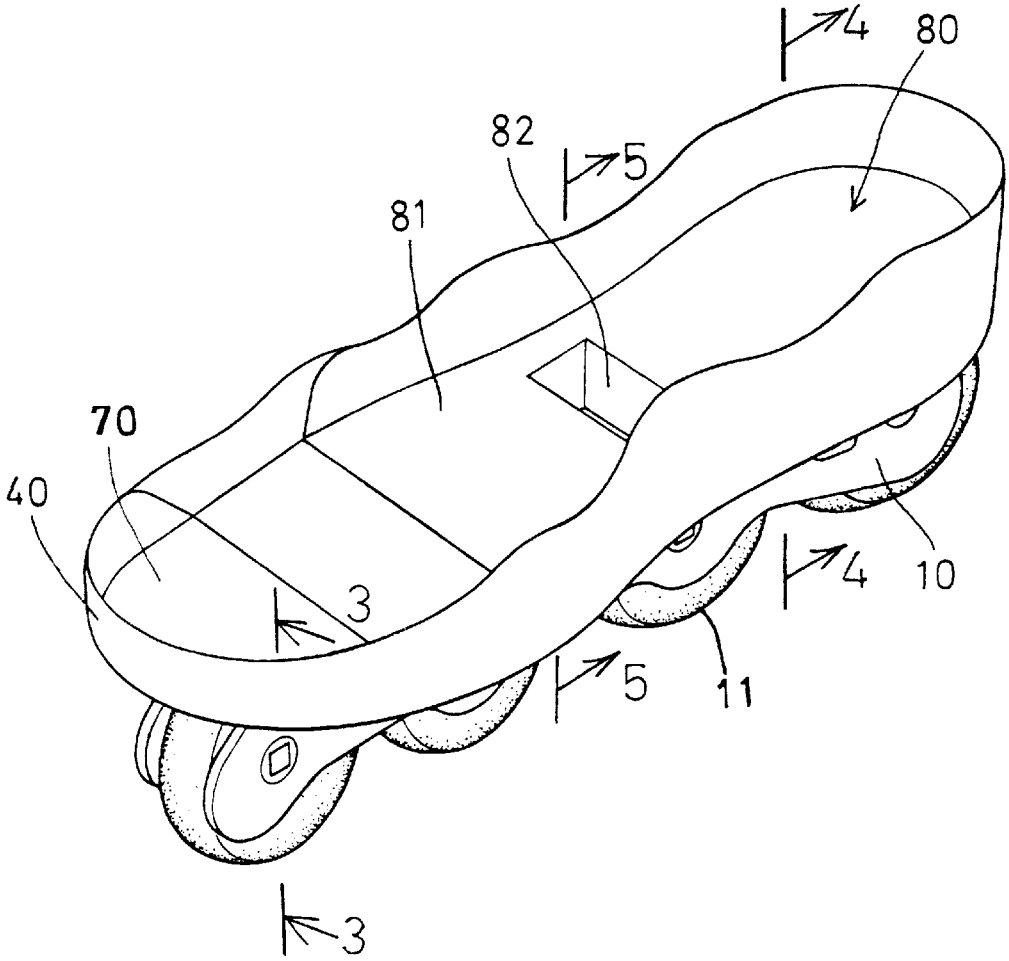
FIG. 1 is a perspective view of a shoe and wheel combination in accordance with the present invention.
Figure 2:
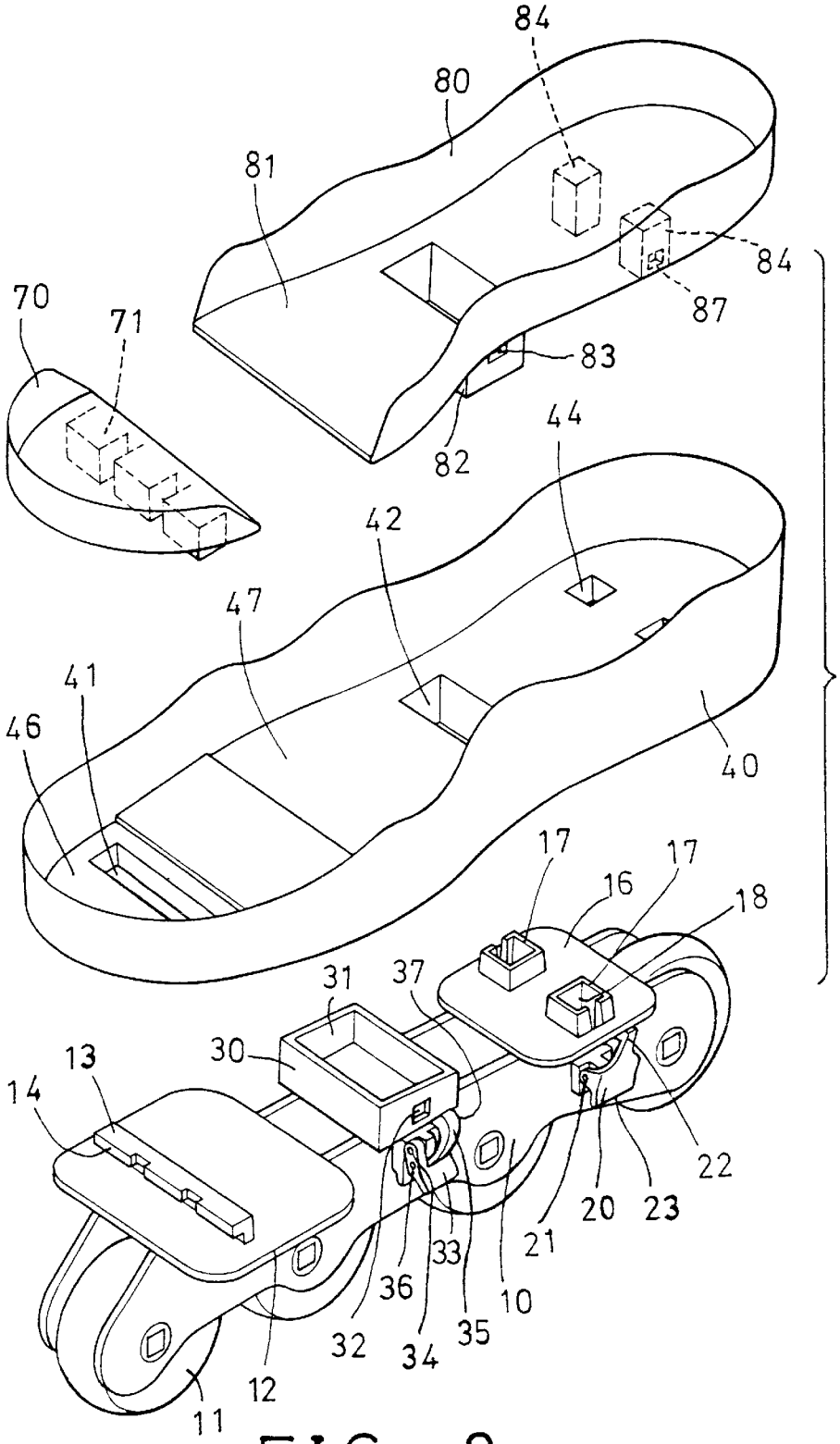
FIG. 2 is an exploded view of the shoe and wheel combination.
Figure 3:
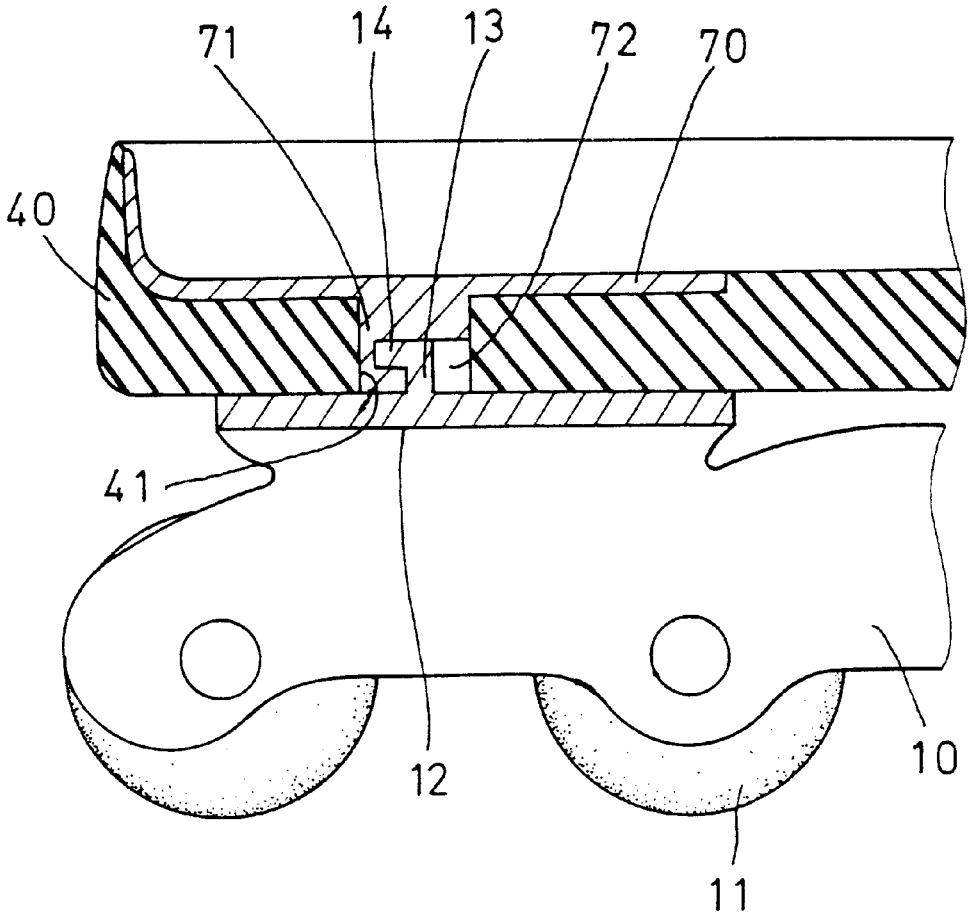
FIGS. 3, 4, 5 are cross sectional views taken along lines 3—3, 4—4, and 5—5 of FIG. 1 respectively.

Referring to the drawings, and initially to FIGS. 1–3, a shoe and wheel combination in accordance with the present invention comprises a wheel device including a frame 10 having one or more wheels 11 rotatably secured thereto for engaging with the ground or the like, and having a plate 12 disposed or provided on one end, such as the front end thereof, and having a board 16 disposed or provided on the other end, such as the rear end thereof. The front portion or the front plate 12 of the wheel device includes a catch 13 extended upward therefrom and having one or more, such as three projections 14 extended forward therefrom.

Figure 4:
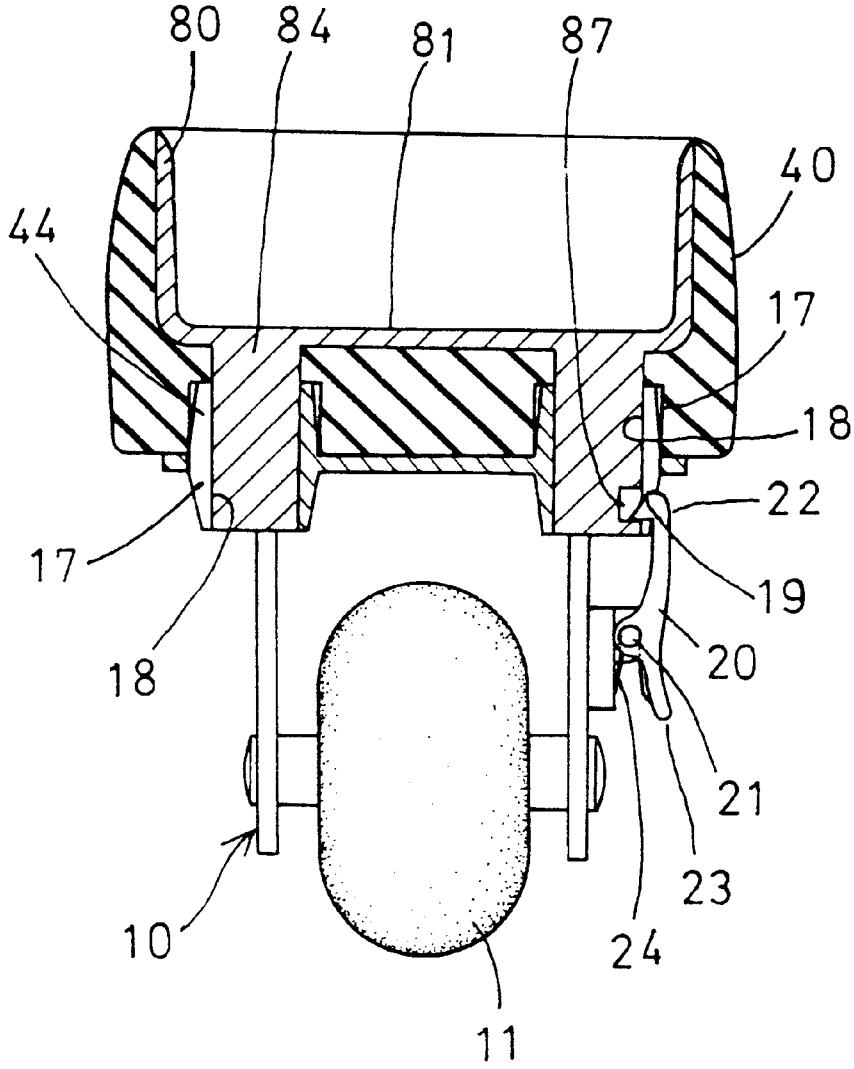

The rear portion or the rear board 16 of the wheel device includes one or more, such as two conduits 17 formed or provided therein and preferably extended upward and downward beyond the board 16, best shown in FIG. 4. The conduits 17 each includes a bore 18 formed therein, and one of the conduits 17 includes an opening 19 (FIG. 4) formed therein and communicating with the bore 18 thereof. A latch 20 has a middle portion pivotally or rotatably secured to the frame 10 with a pivot shaft 21, and includes a hook 22 provided on one end thereof for engaging into the opening 19 of the conduit 17, and includes a knob 23 provided on the other end thereof for forcing or for disengaging the hook 22 from the conduit 17. A spring 24 or the like may be engaged between the knob 23 and the frame 10 for biasing the hook 22 to engage into the opening 19 of the conduit 17.

Figure 5:
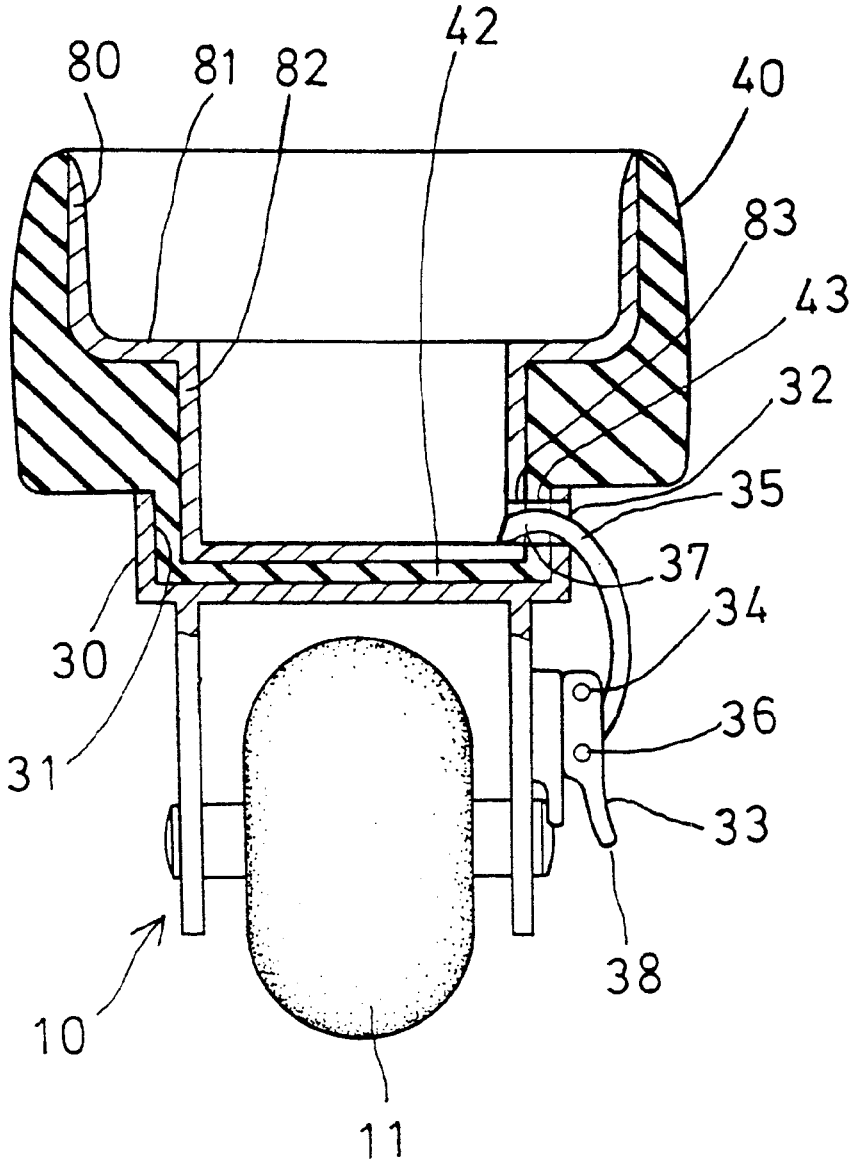

As shown in FIGS. 1 and 5, a receptacle 30 is disposed or provided or formed on the frame 10, such as provided on the middle portion of the frame 10, and includes a chamber 31 formed therein, and includes an orifice 32 formed in one side thereof and communicating with the chamber 31 thereof. A lever 33 has one end, such as the upper end pivotally or rotatably secured to the frame 10 with a pivot axle 34, and includes a hand grip 38 formed or provided on the other end, such as the lower end thereof. An arm 35 includes one end, such as the lower end pivotally or rotatably secured to the middle portion of the lever 33 with a pivot pin 36, and includes a tongue 37 formed or provided on the other end, such as on the upper end thereof for engaging into the orifice 32 of the receptacle 30.

The shoe and wheel combination includes a shoe 40 to be detachably secured onto the frame 10 of the wheel device. The shoe 40 is preferably made of soft or resilient materials, such as the typical rubber or synthetic materials, and may be used as the typical shoes, such as the sports shoes or the like when the shoe 40 is disengaged from the frame 10 of the wheel device. For clearly showing the securing of the shoe 40 onto the frame 10 of the wheel device, only the shoe sole of the shoe 40 has been shown in the drawings, such that the shoe sole of the shoe 40 represents the shoe to be detachably secured onto the frame 10 of the wheel device.

The shoe 40 includes one end, such as the front end having a passage 41 formed or provided therein for receiving the catch 13 and the projections 14 of the plate 12, and having a recess 46 formed in the upper portion thereof and communicating with the passage 41 thereof. The rear portion of the shoe 40 includes one or more, such as two cavities 44 formed therein for receiving the upper portions of the conduits 17 of the rear board 16 respectively (FIG. 4). The shoe 40 includes a housing 42 formed or provided or extended downward from the middle portion thereof and having an aperture 43 formed in the side portion thereof (FIG. 5) for receiving the tongue 37 of the arm 35. The shoe 40 also includes a depression 47 formed in the middle and the rear portion thereof and communicating with the housing 42 and the cavities 44 thereof.

A toe member 70 has a lower portion engaged in the recess 46 of the shoe 40 and includes one or more, such as three blocks 71 extended downward therefrom and engaged into the passage 41 of the shoe 40. The blocks 71 each includes a lock notch 72 (FIG. 3) formed therein for receiving the catch 13 and the projections 14 of the front plate 12 and for detachably securing or latching or locking the front portions of the shoe 40 to the front plate 12 of the frame 10. In assembling, the projections 14 of the front plate 12 may first be engaged upward into the lock notches 72 of the blocks 70 and then may be moved forward to solidly engage into the lock notches 72 of the blocks 70 and to detachably lock the front portions of the shoe 40 to the front plate 12 of the frame 10. The toe member 70 is made of stronger materials, such as plastic materials, metal materials, composite materials, or the like. The front portions of the shoe 40 and the plate 12 of the frame 10 may thus be easily and quickly secured or latched together without additional fasteners.

A heel member 80 includes a bottom panel 81 engaged in the depression 47 of the shoe 40, and includes a casing 82 extended downward therefrom, such as extended downward from the front portion thereof, and engaged into the housing 42 of the shoe 40. The casing 82 includes an aperture 83 formed therein and aligned with the aperture 43 of the housing 42 and the orifice 32 of the receptacle 30 (FIG. 5). In assembling, the tongue 37 of the arm 35 may be engaged into the orifice 32 of the receptacle 30 and the aperture 43 of the housing 42 and the aperture 83 of the casing 82, and may be hooked to the casing 82. The hand grip 38 of the lever 33 may then be rotated to engage with the frame 10 and to quickly lock the casing 82 to the frame 10. The lever 33 and the arm 35 thus form a quick release locking device for detachably locking the heel member 80 and the middle portion of the shoe 40 to the frame 10.

The heel member 80 includes one or more protrusions 84 extended downward from the rear portion thereof, and engaged into the cavities 44 of the shoe 40 and engaged into the conduits 17 of the rear board 16. One or the protrusions 84 includes an orifice 87 formed therein and aligned with the opening 19 of the conduit 17 (FIG. 4). In assembling, the hook 22 of the latch 20 may be engaged into the opening 19 of the conduit 17 and the orifice 87 of the protrusion 84 may be engaged with the protrusion 84 for further detachably locking the heel member 80 and the rear portion of the shoe 40 to the frame 10. The heel member 80 is also made of stronger materials, such as plastic materials, metal materials, composite materials, or the like.

In assembling the frame 10 of the wheel device and the shoe 40 together, the blocks 71 of the toe member 70 may be engaged into the passage 41 of the shoe 40. The projections 14 of the front plate 12 may then be engaged into the lock notches 72 of the blocks 71 and may be moved forward relative to the shoe 40, for detachably securing the front portion of the shoe 40 and to the front plate 12 of the frame 10 with the toe member 70, without additional fasteners. The hook 22 of the latch 20 may then be engaged into the opening 19 of the conduit 17 and the orifice 87 of the protrusion 84 for quickly and detachably locking the heel member 80 and the rear portion of the shoe 40 to the frame 10. The shoe 40 may thus be easily and quickly secured to the frame 10 and may be easily and quickly disengaged from the frame 10 by disengaging the hook 22 of the latch 20 from the protrusion 84.

The tongue 37 of the arm 35 may further be engaged into the orifice 32 of the receptacle 30 and the aperture 43 of the housing 42 and the aperture 83 of the casing 82, and may be hooked to the casing 82. The hand grip 38 of the lever 33 may then be rotated to engage with the frame 10 and to quickly lock the casing 82 to the frame 10. The heel member 80 may thus be further solidly secured to the frame 10 by the lever 33 and the arm 35. The wheel device may thus be easily and quickly assembled onto the bottom of the shoe 40 without additional fasteners.

Accordingly, the shoe and wheel combination in accordance with the present invention includes an easily and quickly detachable structure or configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shoe and wheel combination comprising:

a shoe including a front portion, a middle portion and a rear portion, a toe member engaged onto said front portion of said shoe, a heel member separated from the toe member and engaged onto said rear portion of said shoe, said heel member including at least one protrusion extended downward therefrom and engaged into said rear portion of said shoe, a wheel device including a front portion, a middle portion, and a rear portion, means for detachably securing said front portion of said wheel device and said toe member together to detachably secure said front portion of said shoe between said toe member and said front portion of said wheel device, means for detachably latching said rear portion of said wheel device and said heel member together to detachably secure said rear portion of said shoe between said heel member and said rear portion of said wheel device, and means for locking said heel member to said middle portion of said wheel device.

2. The shoe and wheel combination according to claim 1, wherein said locking means includes a quick release lock device attached to said middle portion of said wheel device and engageable with said heel member for locking said heel member to said middle portion of said wheel device.

3. The shoe and wheel combination according to claim 2, wherein said quick release lock device includes a lever rotatably secured to said middle portion of said wheel device, and an arm having a first end rotatably secured to said lever and a second end for engaging with said heel member and for locking said heel member to said middle portion of said wheel device.

4. The shoe and wheel combination according to claim 3, wherein said heel member includes a casing extended downward therein and engaged into said shoe, said arm is engaged with said casing for locking said casing to said wheel device.

5. The shoe and wheel combination according to claim 4, wherein said casing includes an aperture formed therein for receiving said arm.

6. The shoe and wheel combination according to claim 4, wherein said shoe includes a housing extended downward therefrom and having an aperture formed therein for receiving said arm.

7. The shoe and wheel combination according to claim 4, further comprising a receptacle provided on said middle portion of said wheel device for receiving said casing.

8. The shoe and wheel combination according to claim 7, wherein said receptacle includes an orifice formed therein for receiving said arm and for allowing said arm to engage with said casing.

* * * * *